US005388312A

United States Patent [19]

Fudaki

[11] Patent Number: 5,388,312

[45] Date of Patent: Feb. 14, 1995

[54] SEPARABLE BOTTOM STOP FOR CONCEALED TYPE SLIDE FASTENER

[75] Inventor: Tsutomu Fudaki, Kurobe, Japan

[73] Assignee: Toshida Kogyo K.K., Tokyo, Japan

[21] Appl. No.: 139,816

[22] Filed: Oct. 22, 1993

[30] Foreign Application Priority Data

Oct. 29, 1992 [JP] Japan ..... 4-075368[U]

[51] Int. Cl.[6] ..... A44B 19/38

[52] U.S. Cl. ..... 24/388; 24/433; 24/432

[58] Field of Search ..... 24/433, 434, 432, 388

[56] References Cited

U.S. PATENT DOCUMENTS

| | | | |
|---|---|---|---|
| 2,146,691 | 2/1939 | Sundback . | |
| 2,154,099 | 4/1939 | Marinsky | 24/388 |
| 2,583,386 | 1/1952 | Moehler | 24/433 |
| 2,649,638 | 8/1953 | Morin . | |
| 2,728,125 | 12/1955 | Wild . | |
| 5,042,117 | 8/1991 | Tsubata | 24/432 X |
| 5,131,120 | 7/1992 | Akashi | 24/433 |

FOREIGN PATENT DOCUMENTS

| | | |
|---|---|---|
| 387939 | 4/1963 | Japan . |
| 51-4816 | 2/1976 | Japan . |
| 2090326A | 7/1982 | United Kingdom . |

*Primary Examiner*—James R. Brittain

*Attorney, Agent, or Firm*—Hill, Steadman & Simpson

[57] ABSTRACT

A separable bottom stop has a hollow socket box having a partition provided longitudinally therein to thus define in the socket box a pair of first and second holes in side-by-side relation to each other. An insert pin is mounted on a lower end of one stringer and is adapted for coming into and out of fitting engagement with the second hole. A socket pin is mounted on a lower end of the other stringer and is reciprocally retained in the first hole. A limiter limits the reciprocation of the socket pin through the first hole to a predetermined distance.

4 Claims, 4 Drawing Sheets

SEPARABLE BOTTOM STOP FOR CONCEALED TYPE SLIDE FASTENER

BACKGROUND OF THE INVENTION

1. Field of the invention

The present invention relates generally to a slide fastener and more particularly to a separable bottom stop for a concealed type slide fastener.

2. Description of the Prior Art

A typical separable bottom stop of the type described is disclosed in Japanese Utility Model Publication No. 38-7939. The disclosed separable bottom stop comprises a socket box mounted on the lower end of one stringer of the slide fastener, a socket pin integrally formed with the socket box and an insert pin mounted on the lower end of the other stringer. When a slider descends to the separable bottom stop, the insert pin is inserted through the slider into the socket box, thereby uniting the lower ends of both stringers.

Another separable end stop for the concealed type slide fastener is disclosed in Japanese Utility Model Publication No. 51-4816. This conventional separable bottom stop also comprises a socket box mounted on the lower end of one stringer of the slide fastener a socket pin integrally formed with the socket box and an insert pin mounted on the lower end of the other stringer. In addition, the socket box includes respective upper extensions extending upward from the rear surface and one side surface in such a way to surround the socket pin, to thus define with the socket pin a guide corner groove, into which the lower part of the slider fits when the slider descends to the separable bottom stop.

However, these conventional separable bottom stops have the following drawbacks.

Each of the conventional separable bottom stops has its socket box and socket pin formed integrally. The socket box and the socket pin in one integral part must be mounted on the concealed type fastener stringer before the concealed slide fastener is sewn to an article, such as clothes. This is obstructive to the sewing operation. When sewing the concealed type slide fastener to an article, such as clothes, a sewer must seam to the edge of the clothes each narrow folded edge of the fastener stringer. The narrow folded edge of the fastener stringer has at the lower end the socket box which constitutes a taxing bar to the sewing operation.

Furthermore, although two opposed fastener element rows are firmly coupled with each other almost throughout the length of the slide fastener, the socket pin and the upper portion of the insert pin sticking from the socket box only touches each other in a region between the lowermost end of the fastener element rows and the upper end of the socket box. Consequently, the fastener stringers are prone to be accidentally spread apart from this region.

In order to prevent the accidental fracture, the insert pin must be stably fitted in the socket box. For this purpose, the insert pin must be inserted into the socket box deep and so the socket box must be made long. However, this results in another disadvantage that it is difficult to insert the insert pin through the slider into the long socket box.

SUMMARY OF THE INVENTION

With the foregoing difficulties in view, it is therefore, an object of the invention to provide a separable bottom stop for a concealed type fastener whose socket box never constitutes a bar to sewing operation of the concealed slide fastener to an article.

It is another object of the present invention to provide a separable bottom stop for the concealed type slide fastener wherein an insert member can be accurately and easily brought into and out of fitting engagement with a socket box.

It is still another object of the present invention to provide a separable bottom stop for the concealed type slide fastener which is quite exempt from causing accidental fracture of the slide fastener.

According to the present invention, there is provided, in a concealed type slide fastener comprising a pair of opposed companion stringers including a pair of stringer tapes having confronting folded edges formed along their respective longitudinal edges and two rows of coupling elements sewn to the respective confronting folded edges and a slider reciprocally mounted on the coupling element rows, a separable bottom stop comprising a hollow socket box having a partition provided longitudinally therein to thus define in the socket box a pair of first and second holes in side-by-side relation to each other; an insert pin mounted on a lower end of one stringer and adapted for coming into and out of fitting engagement with the second hole; a socket pin mounted on a lower end of the other stringer and reciprocally retained in the first hole; and means for limiting the reciprocation of the socket pin through the first hole to a predetermined distance.

Many other advantages and features of the present invention will become manifest to those versed in the art upon making reference to the detailed description and the accompanying sheets of drawings in which preferred embodiments incorporating the principles of the present invention are shown by way of illustrative example.

DETAILED DESCRIPTION OF THE PRESENTLY PREFERRED EMBODIMENTS

Before getting down to detailed description of a separable bottom stop S according to the present invention, description is first made to a concealed type slide .fastener on a lower end of which the separable bottom stop is to be mounted.

Figure 1:
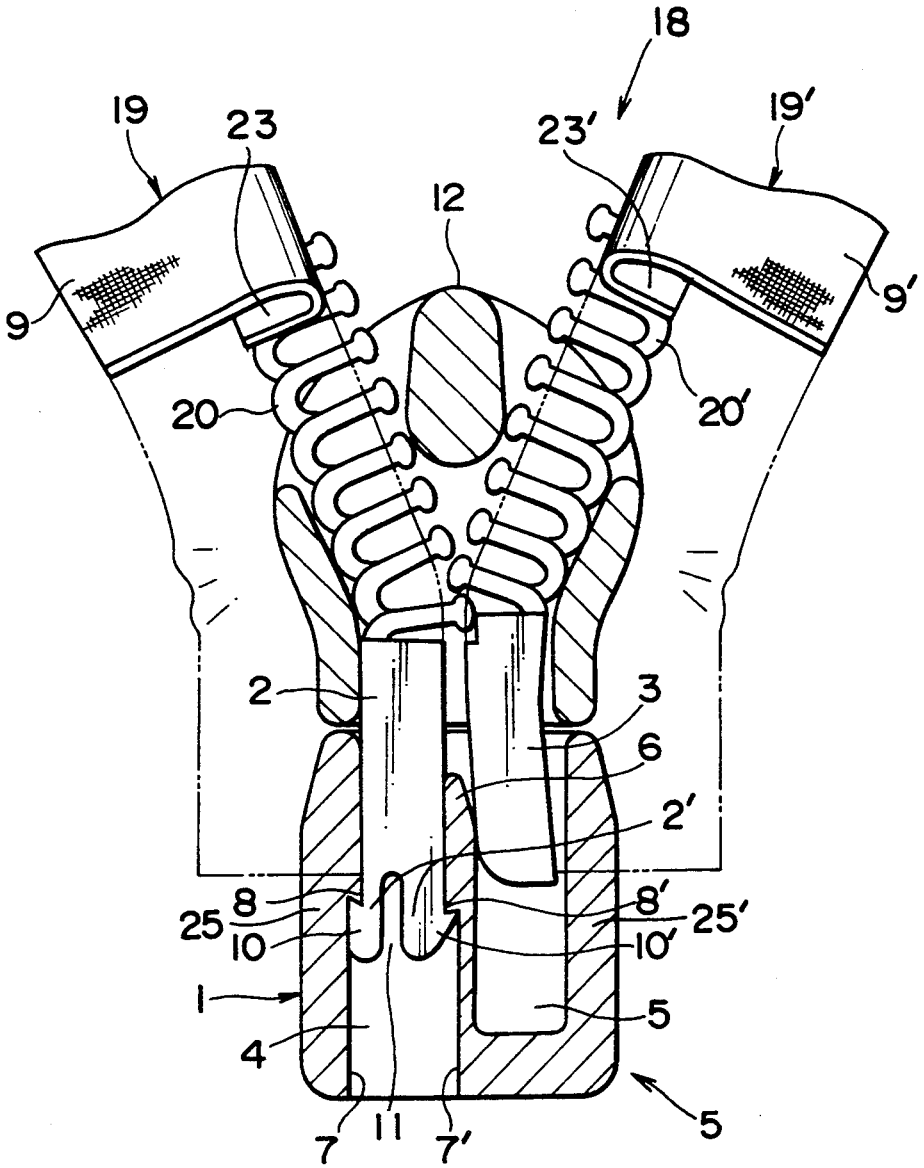
FIG. 1 is a fragmentary cross-sectional view of a lower end of a concealed type slide fastener incorporating a separable stop according to the present invention.

Referring now to the drawings and FIG. 1 in particular, there is shown the lower end of the concealed type separable slide fastener 18. The concealed type slide fastener 18 comprises a pair of opposed companion stringers 19, 19', which includes a pair of stringer tapes 9, 9' having confronting folded edges 23, 23' formed along their respective longitudinal edges and two rows of coupling elements 20, 20' sewn to the respective confronting folded edges 23, 23'. Although the coupling elements are shown to be in the form of a helical convolution, they may be in any suitable form as recognized in this field. A slider 12 is reciprocally mounted on the coupling element rows 20, 20' for bringing the coupling element rows of the two companion stringers 19, 19' into and out of interlocking engagement with each other. As better shown in FIG. 4, the slider 12 has a pull tab 30 pivotally mounted on a front part thereof for manipulation of the slider 12.

As better shown in FIG. 1, the separable bottom stop S broadly comprises a socket box 1, a socket pin 2 and an insert pin 3.

Figure 4:
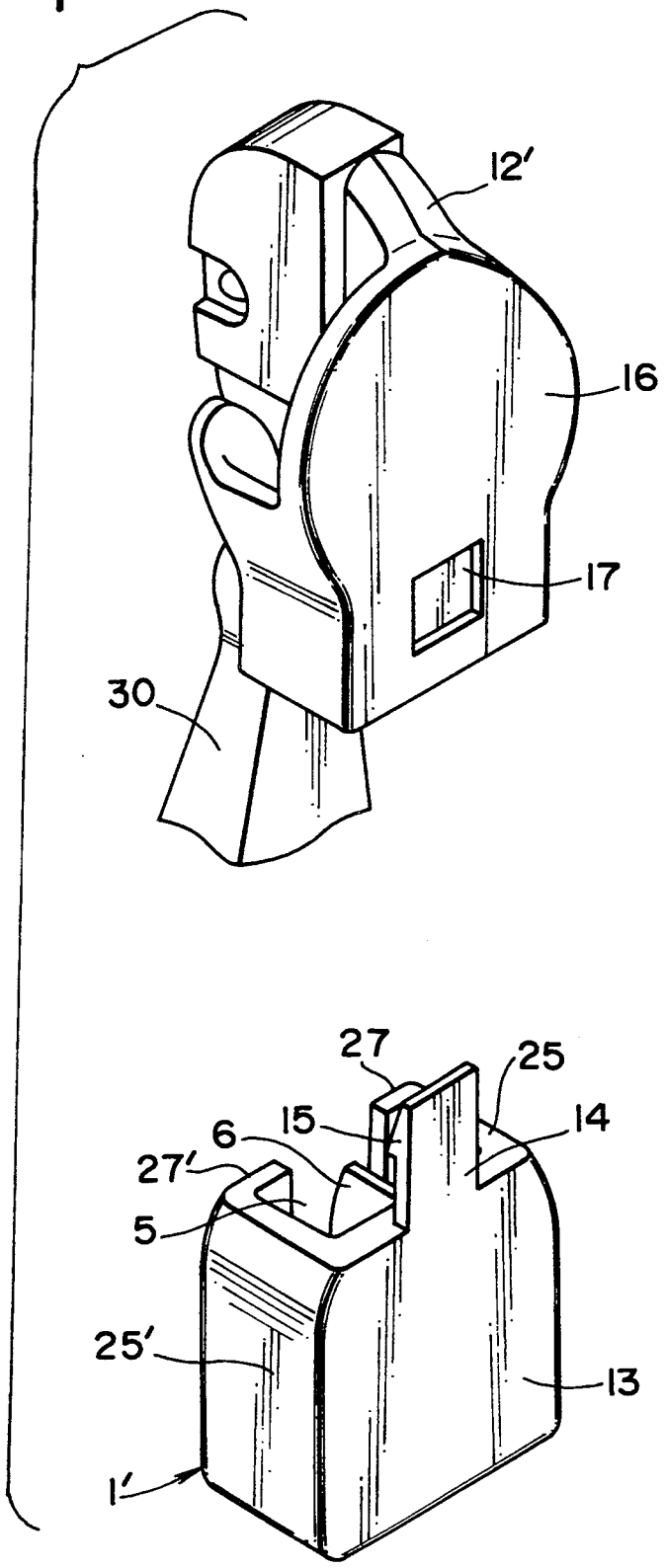
FIG. 4 is a perspective view showing the separable bottom stop according to the present invention and a slider associated therewith.

To be precise, FIG. 4 shows a socket box 1' according to another embodiment described hereinafter, but the general construction of the socket box 1' is substantially the same as that of the socket box 1 according to this embodiment. Therefore, the description of the socket box 1 is also made in conjunction with FIG. 4. As better shown in FIG. 4, the socket box 1 is substantially in the form of a rectangular box and generally comprises a pair of side walls 25, 25', a rear wall 13 joined at the opposed sides with the rear edges of the side walls 25, 25' and a pair of front flanges 27, 27' extending along the front edges of the side walls 25, 25'.

A partition 6 is provided longitudinally on the inner side of the rear wall 13 substantially halfway of the width of the rear wall 13. The partition 6 defines a through first hole 4 with part of the rear wall 13, one side wall 25 and one front flange 27; and a blind second hole 5 with part of the rear wall 13, the other side wall 25' and the other front flange 27', so that the through first hole 4 and the blind second hole 5 extend in side-by-side relation with each other with the partition 6 interposed therebetween. The through first hole 4 and the blind hole 5 are intended for fitting therein of the socket pin 2 and the insert pin 3, respectively. The side wall 25 and the partition 6 have a pair of confronting locking overhangs 8, 8' provided on their respective opposed inner surface 7, 7' substantially halfway of the length of the through first hole 4, so that the upper part of the first hole 4 is slightly smaller in width than the lower part of the through hole 5, to be exact, by the combined widths of the confronting locking overhangs 8, 8'.

As better shown in FIG. 1, the socket pin 2 is substantially rectangular, of substantially U-shaped cross-section and has a groove (not shown) formed along the length thereof. The lower end of the longitudinal edge of the corresponding stinger tape 9 is fixedly embedded in the groove. The socket pin 2 has a pair of opposed locking fins 10, 10' formed on the opposed sides of the lower end so as to project outwardly therefrom for locking engagement with the locking overhangs 8, 8', respectively, of the front hole 4. The socket pin 2 has a longitudinal slot 11 cut longitudinally in the lower end portion to thus provide a resilient bifurcated lower end portion 2'.

As shown in FIG. 1, the insert pin 2 is, likewise, substantially rectangular, of substantially U-shaped cross-section and has a groove (not shown) formed along the length thereof. Unlike the socket pin 2, the insert pin 3 is arcuate outwardly. The locking end of the longitudinal edge of the corresponding stringer tape 9' is fixedly embedded in the groove. The insert pin 3 is adapted for fitting engagement with and out of the blind second hole 5.

Forcing the socket pin 2 through the narrowed upper part of the first through hole 4 causes the resilient bifurcated lower end portion 2' of the socket pin 2 compressed laterally thereof against its resiliency and come through the narrowed upper part until the locking fins 10, 10' of the socket pin 2 passes beyond the confronting locking overhangs 8, 8' of the first hole 4, whereupon the locking fins 10, 10' comes into locking engagement with the locking overhangs 8, 8' of the first hole 4 under the resiliency of the resilient bifurcated lower end portion 2' of the socket pin. With such locking engagement of the locking fins 10, 10' of the socket pin 2 with the locking overhangs 8, 8' of the second hole 4, once the socket pin is resiliently inserted into the first hole 4, the socket pin 2 will never come thereoff. The socket pin 2 can reciprocate within the narrow lower part of the first hole 4 within a predetermined distance to which the locking engagement of the locking fins 10, 10' with the locking overhangs 8, 8' limits the reciprocation. The socket pin 2 reciprocates through the wide lower part of the first hole 4 with its locking fins 10 resiliently engaged with the inner surface of the first hole 4.

Since the socket box 1 is separate from the socket pin 2 and can be resiliently joined with the socket pin 2, the socket box 1 can be joined to the slide fastener 18 after the slide fastener 18 has been sewn to an article. Consequently, the socket box 1 of the separate bottom stop S according to this invention will not constitute any bar to the sewing operation which were the case with the conventional devices.

Figure 2:
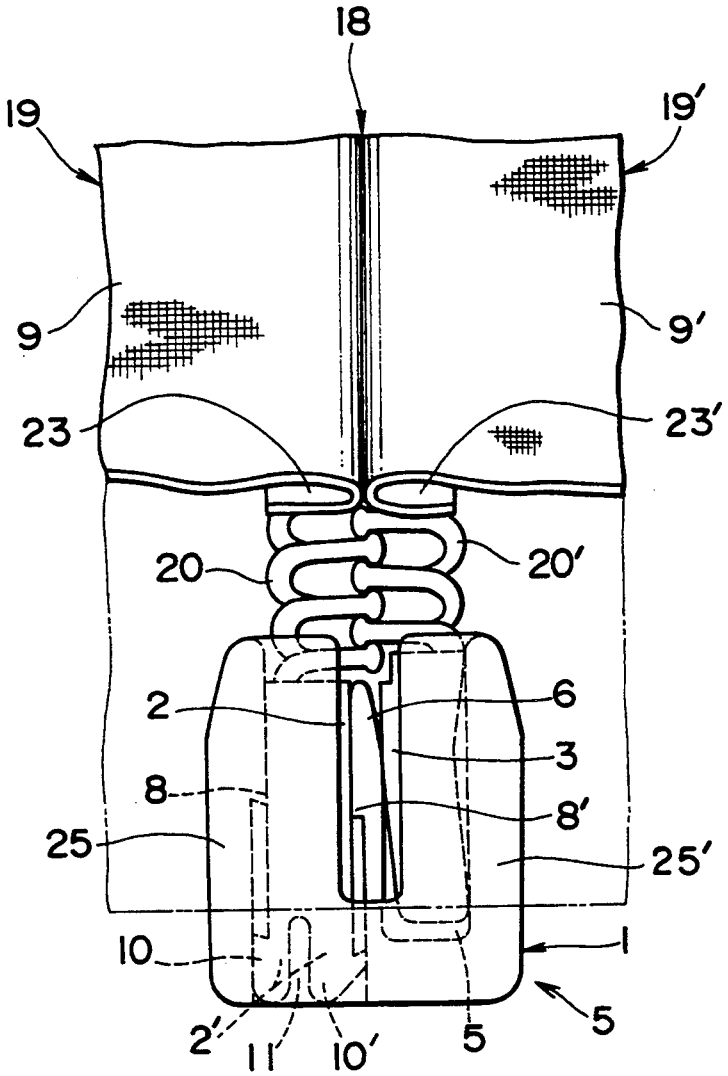
FIG. 2 is a fragmentary plan view of the lower end of the concealed type slide fastener of FIG. 1.
Figure 3:
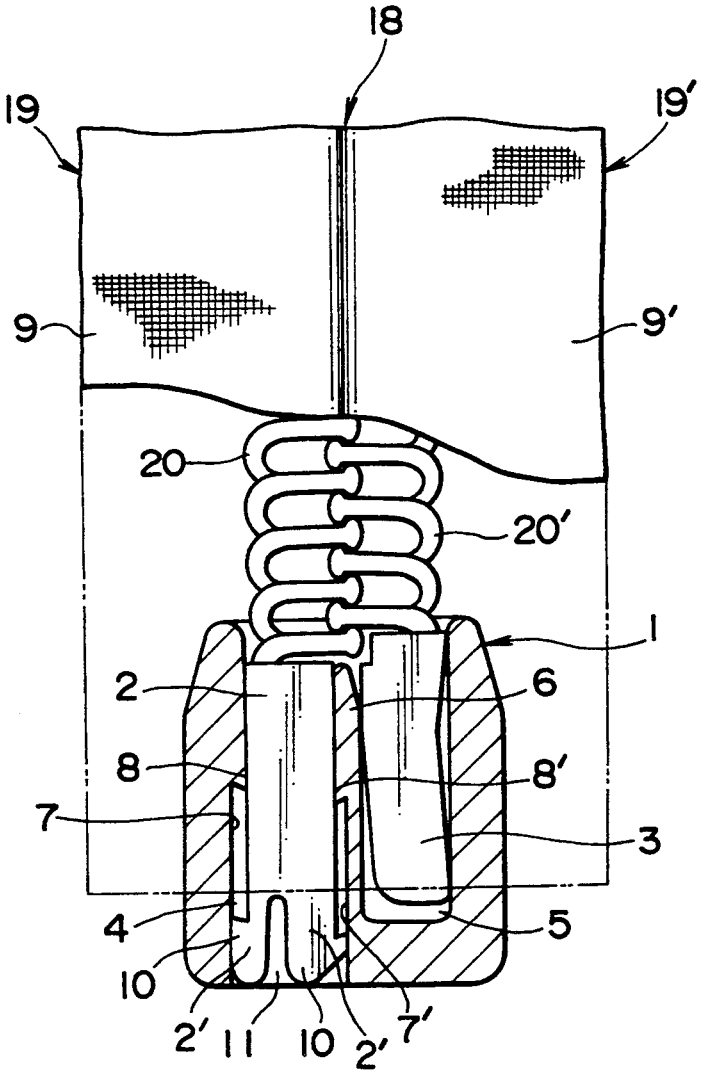
FIG. 3 is a view similar to FIG. 2, but showing a socket box in cross-section.

For closing the slide fastener 18, first the slider 12 slides down through the element row 20 of the stringer 19 and comes into abutting engagement with the socket box 1. And, as shown in FIG. 1, the insert pin 3 is inserted through a channel 12' of the slider 12 into halfway of the second hole 5. Subsequently, the slider 12 is pulled up along the coupling element rows 20, 20' to thus bring the coupling element rows 20, 20' of the opposed stringers 19, 19' into coupling engagement with each other. Eventually, the socket box 1 is thrust upward by fingers to the predetermined distance so that the socket pin 2 and the insert pin 3 are fully fitted into the first hole 4 and the second hole 5, respectively, of the socket box 1, as shown in FIGS. 2 and 3.

For opening the slide 12 fastener 18, first the slider is pulled all the way down and comes into abutting engagement with each other. Continued pull-down of the slider 12 causes the socket box 1 to move down the predetermined distance as shown in FIG. 1. Then, the insert pin 3 is pulled up and taken out of the second hole 5 of the socket box 1 through the channel 12' of the slider 12, thus bringing the stringer 19' apart from the other stringer 19, so that the slide fastener 18 is opened.

FIG. 4 shows another embodiment of the present invention. This embodiment is substantially identical with the preceding embodiment except for provision of a resilient extension 14 on the socket box 1' and a special relation of the socket box 1' to the slider 12'.

As shown in FIG. 4, the socket box 1 has a rectangular resilient extension 14 formed integrally with and extending upward from the rear wall 13. The resilient extension 14 has a protuberant lug 15 projecting forward from an upper end thereof. The slider 12 has a recess 17 formed in a rear plate 16. When the slider 12 descends and comes into abutting engagement with the separable bottom stop S, the recess 17 of the slider 12 comes into locking engagement with the protuberant lug 15 of the socket box 1' under the resiliency of the resilient extension 14 of the socket box 1'. With the recess 17 engaged with the protuberant lug 15 of the resilient extension 14, ascent of the slider 12 for closing the slide fastener 18 causes the socket box 1' to move up with the slider 12 the predetermined distance from the position shown in FIG. 1 to the position shown in FIGS. 2 and 3. This means that the socket box 1' of the separable bottom stop S according to this embodiment automatically comes into deeper engagement with the slide fastener 18 and dispenses with manual thrust of the socket box 1 which is required therefor with the separable bottom stop 1 according to the preceding embodiment.

Instead of the two confronting locking overhangs 8, 8' and the corresponding two locking fins 10, 10', the first hole 4 may have only one locking overhang 10 on its inner substantially halfway of a length thereof, and the socket pin 2 may have only one locking fin 8 on a lower end thereof so as to project laterally outwardly therefrom for locking engagement with the locking overhang 8.

With the construction set forth above, the separable bottom stop according to the present invention has the following advantages:

Since the socket pin is reciprocally movable through the socket box to the predetermined distance, the socket pin can stick out of the socket box as shown in FIG. 1 and act for guiding the insert pin in coming into and out of the second hole of the socket box through the channel of the slider, thus rendering inserting and releasing operation of the insert pin very easy.

Furthermore, since upward thrust of the socket box to the predetermined distance causes the socket pin and the insert pin fully fitted into the first hole, and the second hole, respectively, of the socket box, the separable bottom stop according to the present invention are quite exempt from the drawbacks that the fastener stringer is prone to be accidentally spread apart from the separable bottom stop.

Since the socket pin has a longitudinal slot cut longitudinally in the lower end portion to provide a resilient bifurcated lower end, the socket pin can be easily joined with the socket box.

Since the socket box is separate from the socket pin and can be resiliently joined with the socket pin, the socket box can be joined to the slide fastener after the slide fastener has been sewn to an article. Consequently, the socket box of the separable bottom stop according to this invention will not constitute any bar to the sewing operation which were the case with the conventional devices.

Obviously, various modifications and variations of the present invention are possible in light of the above teaching. It is, therefore, to be understood that within the scope of the appended claims the invention may be practiced otherwise than as specifically described.

What is claimed is:

1. In a concealed type slide fastener comprising:

a pair of opposed companion stringers including a pair of stringer tapes having confronting folded edges formed along their respective longitudinal edges and two rows of coupling elements sewn to the respective confronting folded edges and a slider reciprocally mounted on the coupling element rows;

a separable bottom stop comprising a hollow socket box having a partition provided longitudinally therein to thus define in the socket box a pair of first and second holes in side-by-side relation to each other;

an insert pin mounted on a lower end of one stringer and adapted for coming into and out of fitting engagement with the second hole;

a socket pin mounted on a lower end of the other stringer and reciprocally retained in the first hole; and means for limiting the reciprocation of the socket pin through the first hole to a predetermined distance wherein the reciprocation-limiting means comprises a pair of confronting locking overhangs formed in opposed inner sides of the first hole substantially halfway of a length thereof and a pair of opposed locking fins provided on opposed sides of a lower end of the socket pin so as to project laterally outwardly therefrom for locking engagement with the locking overhangs.

2. The separable bottom stop according to claim 1 wherein the socket pin has a longitudinal slot cut longitudinally in the lower end portion to provide a resilient bifurcated lower end portion.

3. The separable bottom stop according to claim 1 wherein the opposed locking fins are adapted for resilient engagement with the inner surface of the first hole.

4. The separable bottom stop according to claim 1 wherein the socket box has a resilient extension formed integrally with and extending upward from a rear wall thereof, the resilient extension having a protuberant lug projecting forward from the upper end thereof and further wherein the slider has a recess formed in a rear plate thereof for locking engagement with the protuberant lug of the socket box when the slider comes down into abutting engagement with the socket box.

* * * * *